US005802444A

United States Patent [19]

Takeuchi et al.

[11] Patent Number: 5,802,444

[45] Date of Patent: Sep. 1, 1998

[54] ELECTROPHOTOGRAPHIC APPARATUS FOR A CONTINUOUS STRIP OF PAPER SHEETS FIXED BY A HEAT FIXING UNIT

[75] Inventors: Youichi Takeuchi; Akihiko Yamazaki, both of Hitachinaka; Shuho Yokokawa, Mito; Kunitomo Takahashi, Hitachinaka; Isao Nakajima, Hitachinaka; Kazuhiro Shimojima, Hitachinaka; Shinya Yamazaki, Mito; Tomomichi Kawashima, Hitachinaka, all of Japan

[73] Assignee: Hitachi Koki Co., Ltd., Tokyo, Japan

[21] Appl. No.: 851,067

[22] Filed: May 5, 1997

[30] Foreign Application Priority Data

| | | | |
|---|---|---|---|
| May 10, 1996 | [JP] | Japan | 8-116399 |
| Oct. 25, 1996 | [JP] | Japan | 8-283727 |
| Oct. 25, 1996 | [JP] | Japan | 8-283734 |
| Oct. 25, 1996 | [JP] | Japan | 8-283739 |

[51] Int. Cl.[6] ..... G03G 15/00

[52] U.S. Cl. ..... 399/384; 399/396; 399/407

[58] Field of Search ..... 399/384, 388, 399/396, 397, 400, 405, 407; 270/32, 39.05; 271/213, 214

[56] References Cited

U.S. PATENT DOCUMENTS

| | | | |
|---|---|---|---|
| 5,008,716 | 4/1991 | Onose et al. | 399/384 X |
| 5,485,260 | 1/1996 | Mitsuya | 399/397 X |
| 5,597,152 | 1/1997 | Chinzei | 270/39.05 |

*Primary Examiner*—William J. Royer

*Attorney, Agent, or Firm*—Antonelli, Terry, Stout & Kraus, LLP

[57] ABSTRACT

An electrophotographic apparatus is provided in which toner stick hardly occurs by improving the cooling effect on the strip of paper sheets after they are heat-fixed. This electrophotographic apparatus includes a fixing unit for heating toner transferred on a continuous strip of paper sheets and fixing the toner, and a folding unit for supplying a folding force to the continuous strip of paper sheets. A conveyer unit is arranged in the back stage of the electrophotographic apparatus for transferring the continuous strip of paper sheets, received from folding unit, in the horizontal direction.

17 Claims, 10 Drawing Sheets

FIG. 12

[ REAM WEIGHT OF PAPER SHEETS ≦ 70kg PAPER ]

| WIDTH OF PAPER SHEET / LENGTH OF PAPER SHEET | 6.5" → 18" | | |
|---|---|---|---|
| 7" ↓ 17" | 1 | 2 | 3 |
| | 2 | 3 | 4 |
| | 3 | 4 | 4 |

FIG. 13

[ REAM WEIGHT OF PAPER SHEETS > 70kg PAPER ]

| WIDTH OF PAPER SHEET / LENGTH OF PAPER SHEET | 6.5" → 18" | | |
|---|---|---|---|
| 7" ↓ 17" | 3 | 3 | 4 |
| | 3 | 4 | 5 |
| | 4 | 5 | 5 |

ELECTROPHOTOGRAPHIC APPARATUS FOR A CONTINUOUS STRIP OF PAPER SHEETS FIXED BY A HEAT FIXING UNIT

BACKGROUND OF THE INVENTION

The present invention relates to an electrophotographic apparatus which has a paper transfer conveyer unit in the back stage of the electrophotographic apparatus.

There is a type of electrophotographic apparatus known as a laser printer which uses a strip of paper sheets of long length folded in a fan-fold manner, that is, a so-called continuous strip of paper formed by connected sheets on which pictures of toner images are printed. In the past, in an electrophotographic apparatus of this kind, paper sheets ejected after completion of image printing have been ejected onto a paper stacker provided in the main body of the electrophotographic apparatus while the paper is being folded into sheets.

In recent years, in an electrophotographic apparatus of this kind, ultra-high speed printing higher than 300 pages/minute has been performed. As the printing speed is increased to higher speeds, there arises a problem in that there is a lack of cooling time for cooling the toner image in the fixing process and during the paper sheet folding process. That is, in a toner image fixing unit of an electrophotographic apparatus, a non-fixed toner image transferred on paper is heated, or heated and pressed, so as to be fixed on the paper by melting and softening of the non-fixed toner image. Therefore, when the paper sheets are folded before the toner, which is melted and softened during fixing, is completely cooled and solidified, the stacked paper sheets are likely to adhere to one another due to the softened state of the toner (hereinafter, this phenomenon is referred to as "toner stick"). As a result, there has been produced defective printed matter. This problem is likely to occur as the printing speed is increased, since the amount of paper per unit time being transferred is increased and the paper cooling (air cooling) time per page in the fixing unit and in the course of the paper stacker is shortened.

Further, in the conventional construction, since the ejected paper sheets are piled and stacked in a paper stacker, the amount of paper stacking has been physically limited and no consideration has been given to stacking a large amount of paper sheets.

Furthermore, in the conventional construction, since the paper sheets cannot be partially extracted from the stacker to confirm the print quality or the like while stacking, there has been an inconvenience in the handling of the paper sheets.

SUMMARY OF THE INVENTION

An object of the present invention is to provide an electrophotographic apparatus in which the problem of toner stick hardly occurs by improving the cooling effect of the continuous strip of paper sheets after the toner is heat-fixed.

Another object of the present invention is to provide an electrophotographic apparatus in which the stacking capacity and the handling easiness of the paper sheets are improved.

A still further object of the present invention is to provide an electrophotographic apparatus in which the cooling effect on the paper sheets and the alignment of the paper sheets can be stabilized regardless of the length of the strip of paper sheets, the width of the paper sheets and the ream weight of the paper sheets.

The objects of the present invention can be attained by providing an electrophotographic apparatus comprising a fixing unit for heating toner transferred onto a continuous strip of paper sheets and for fixing the toner on the continuous strips of paper sheets; a folding unit for supplying a folding force to the continuous strip of paper sheets transferred from the fixing unit; a stacking means for stacking the folded strip of paper sheets; and a gap forming means arranged upstream of the stacking means for transferring the folded strip of paper sheets while forming gaps in the folds of the folded strip of paper sheets.

BRIEF DESCRIPTION OF THE DRAWINGS

FIG. 12 is an explanatory diagram showing the relationship between a combination of a number of paper cooling units in operation and the air flow rates, and length of the paper sheet, the width of the paper sheet and the ream weight of the paper sheets.

FIG. 13 is an explanatory diagram showing the relationship between a combination of a number of paper cooling units in operation and the air flow rates, and the length of the paper sheet, the width of the paper sheet and the ream weight of the paper sheets.

DETAILED DESCRIPTION OF THE PREFERRED EMBODIMENTS

Figure 1:
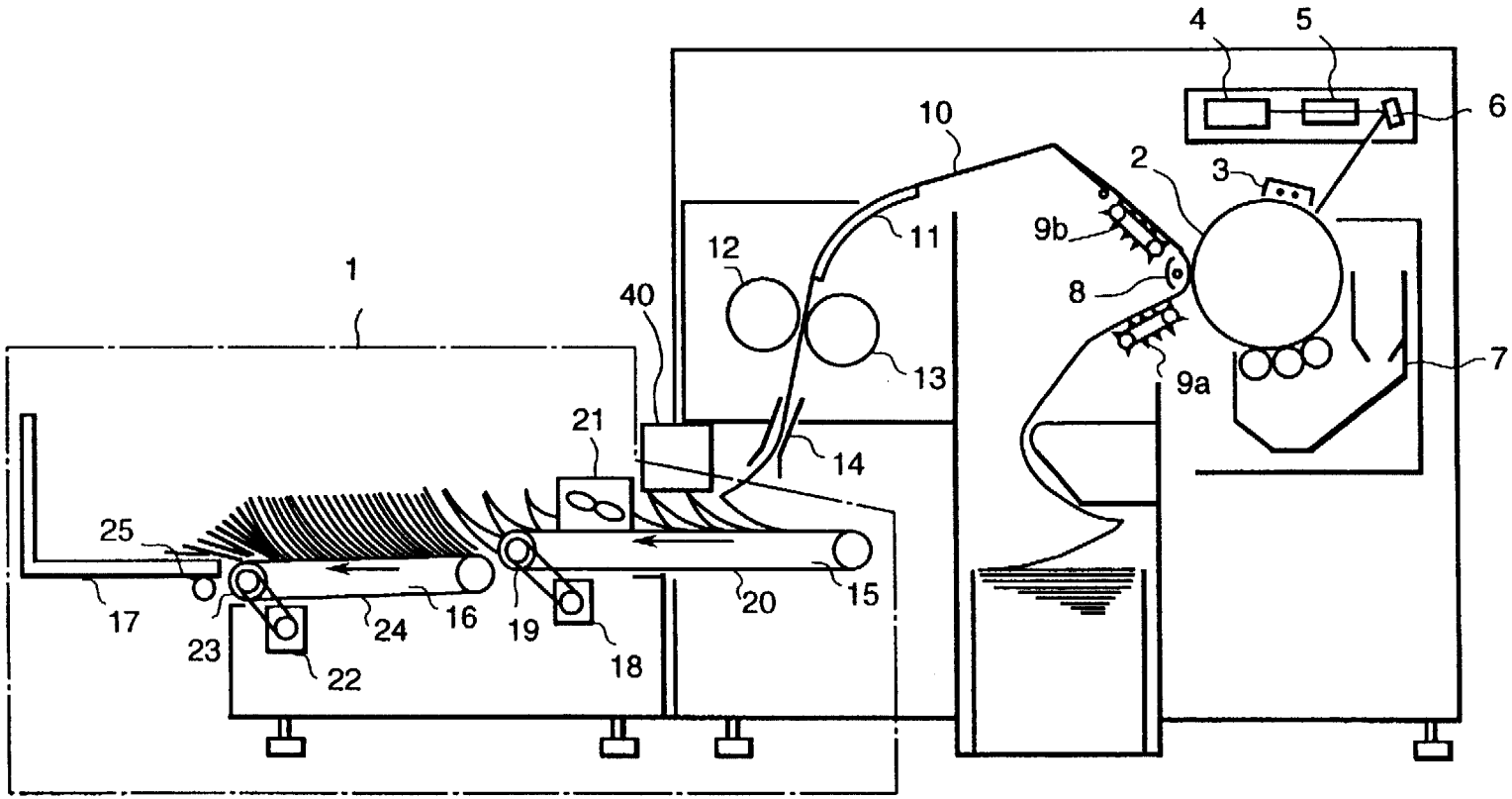
FIG. 1 is a schematic diagram showing the construction of an embodiment of an electrophotographic apparatus in accordance with the present invention.

An embodiment of the present invention will be described in detail below, with reference to the accompanying drawings. Referring to FIG. 1, when a print operation starting signal is output from a controller in an electrophotographic apparatus, a photosensitive body 2 having photoconductivity starts rotating with a speed corresponding to a predetermined print speed. The photosensitive body 2 has applied thereto, for example, a positive high voltage by a charger 3 and the surface of the photosensitive body 2 is uniformly charged.

Rotation of a polygon mirror 4 is started soon after the power source of the electrophotographic apparatus is turned on. Then, a laser beam output from a laser tube 5 is reflected by the polygon mirror 4 and is scanned on the photosensitive body 2 through an Fθ lens 6. Character data and/or picture data converted into dot images by a controller are launched inputted to the electrophotographic apparatus as laser ON-OFF signals and the thus modulated laser beam is irradiated to the photosensitive body 2.

A toner positively charged by a developer 7 is electrostatically attracted and attached onto portions of the photosensitive body 2 discharged by the irradiation of the laser beam to form a toner image. The toner image formed on the photosensitive body 2 is transferred by a transferring unit 8 onto a strip of paper sheets 10 transferred by tractors **9*a*, 9*b*. Further, the toner image is pre-heated by a pre-heating plate 11 of the fixing unit and then heated and pressed by a heating roll 12 and a pressing roll 13 to be melted and fixed onto the paper sheet 10**.

The strip of printed paper sheets 10 is loaded on a first conveyer 15 of the paper transferring conveyer unit 1 while the strip of paper sheets is being folded by the swinging action of a swing fin 14 of a folding unit along perforations provided in the strip of paper sheets 10 in advance.

The paper transferring conveyer unit 1 is composed of a first conveyer 15 for mainly providing paper cooling time, a second conveyer 16 for mainly reserving the stacking capacity and a paper sheet vertical stacking portion 17. The paper sheet vertical stacking portion 17 is supported rotatably with respect to a shaft 25 as the fulcrum. When the quantity of the paper sheets transferred from the second conveyer 16 reaches a predetermined value, the paper sheet vertical stacking portion 17 is rotated from the state shown in FIG. 1 in the counterclockwise direction by 90 degrees, and thereby the paper sheets are changed from a horizontally stacked state to a vertically stacked state and are then taken out.

In the first conveyer 15, a driving roller 19 is rotated at a high speed of rotation by a driving force transmitted from a motor 18, so that a belt 20 is also rotated at a high speed to transfer the strip of paper sheets 10 in a horizontally stacked state while the pitches of the strip of paper sheets 10 (distance between folded portions in the top side or distance between folded portions in the bottom side) are being shifted in the transferring direction. As a result, a gap is produced between the paper sheets adjacent to each other. In this state, the paper sheets can be efficiently cooled by blowing cooling air from a paper cooling unit 21 into the gap between adjacent sheets.

In the second conveyer 16, a driving roller 23 is rotated at a low speed of rotation by a driving force transmitted from a motor 22, so that a belt 24 is also rotated at a low speed to increase the horizontal stacked density of the strip of paper sheets 10 transferred from the first conveyer 15 and thereby reserve the stacking capacity.

An optimum range of the transferring speed of the first conveyer is determined by the printing speed of the printer, the length of the paper sheets and the thickness of the paper sheets. For instance, in a case where the length of the first conveyer 15 is approximately 750 mm, in which approximately 380 mm is a paper cooling region, and the printing speed is 310 pages/minute, the length of the paper sheets (distance between perforation lines) is 11 inches and the thickness of the paper sheets (ream weight of paper sheets) is 50 kg paper to 70 kg paper, the transferring speed of the first conveyer 15 is set to 25 mm/second and the transferring speed of the second conveyer 16 is set to 0.9 mm/second.

Figure 2:
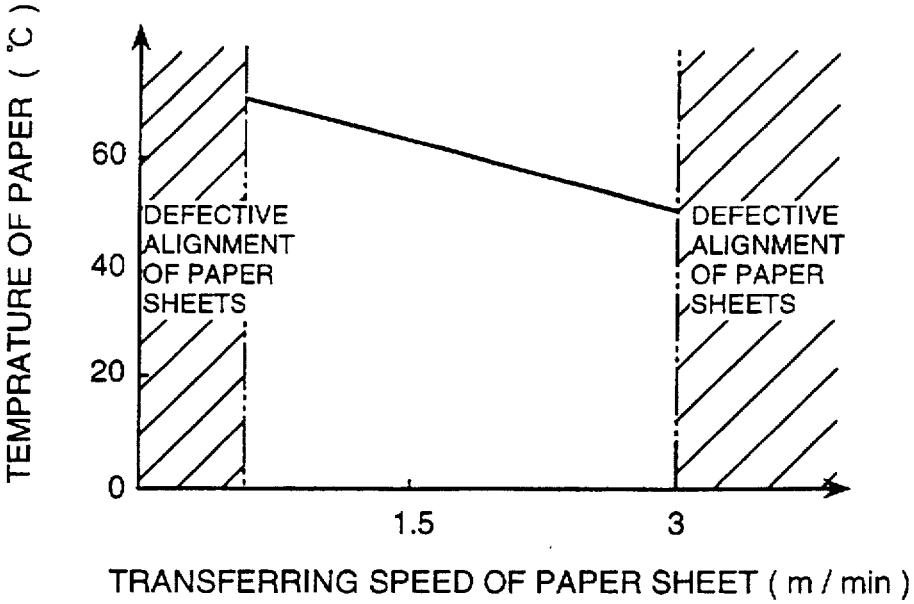
FIG. 2 is a graph explaining the relationship between the transferring speed of a paper sheet of a conveyor and the temperature of the paper sheet.

FIG. 2 shows the relationship between the transferring speed of the conveyer belt 20 of the first conveyer 15 and temperature of the paper sheet. It can be understood that the temperature of the paper sheets decreases as the transferring speed is increased. The reason is that, since the gap between the paper sheets is increased as the transferring speed is increased, the cooling effect of the paper sheets is increased. Since there is a zone in which defective alignment of paper sheets occurs depending on the paper sheet transferring speed of the conveyer 15, the most efficient paper cooling can be attained when the paper sheet transferring speed is set to a maximum transferring speed at which a paper jam is not caused. In the case of a printing speed of 300 pages/minute, the paper sheet transferring speed approximately corresponds to the 1.5 m/min speed shown in FIG. 2.

The first conveyer 15 is constructed such that an operator can control the transferring speed within the range of ±50% to a setting value.

Figure 3A:
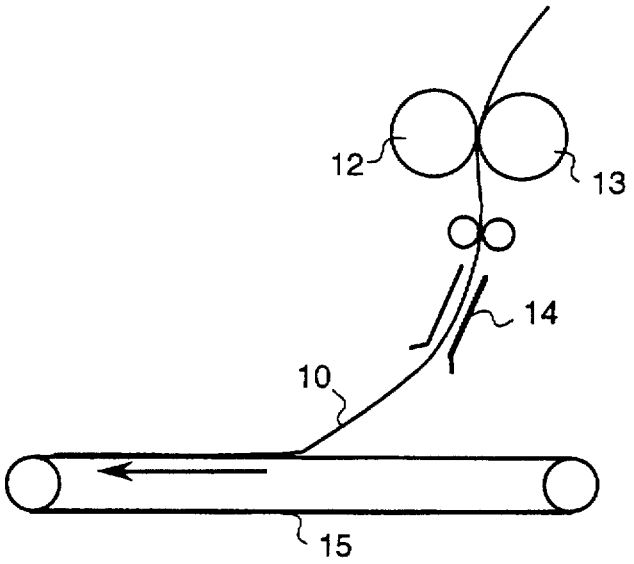
FIGS. 3A and 3B are diagrams showing the relationship between the paper sheet transferring speed of a first conveyer and the state of the paper sheet.
Figure 3B:
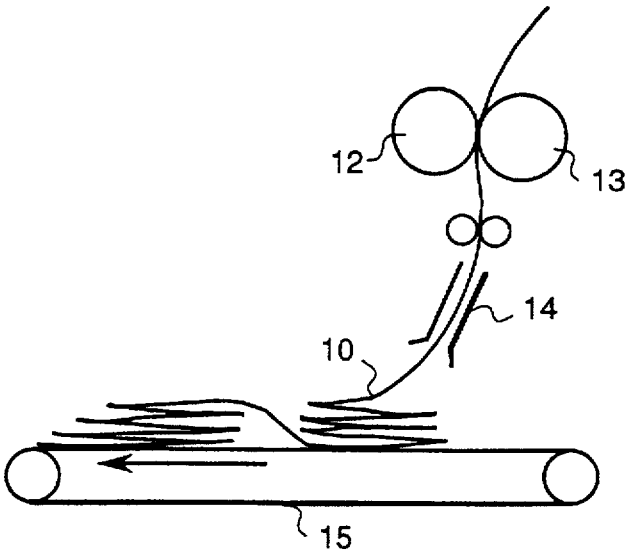

The diagonally shaded zone at the left hand side in FIG. 2 as well as the diagonally shaded zone at the right hand side indicates zones where defective alignment of paper sheets occurs. That is, when the paper sheet transferring speed is too fast (in a case of the diagonally shaded zone at the right hand side), the paper sheets are not folded in a zigzag shaped state on the first conveyer 15, but are transferred on the first conveyer 15 in a flat state, as shown in FIG. 3A. In this case, since gaps for cooling the paper sheets are not formed between the folds of the paper sheets, a sufficient cooling effect can not obtained. On the contrary, when the paper sheet transferring speed is too slow (in a case of the diagonally shaded zone at the left hand side), partial paper sheet stacks are formed on the first conveyer 15, as shown in FIG. 3B, since the following paper sheets are ejected before the preceding paper sheets are transferred by an appropriate distance. In this case, since gaps for cooling the paper sheets are not formed between the folds of the paper sheets, a sufficient cooling effect can not obtained either.

When the paper sheets having a large gap between the folds of the paper sheets on the conveyer 15 are passed to the second conveyer 16, the gap between the folds can be decreased by setting the paper sheet transferring speed on the conveyer 16 to a speed slower than the paper sheet transferring speed on the conveyer 15. By doing so, it is possible to increase the paper sheet stacking capacity per unit length, and accordingly the length of the conveyer 16 in the paper transferring direction can be made shorter.

Figure 4:
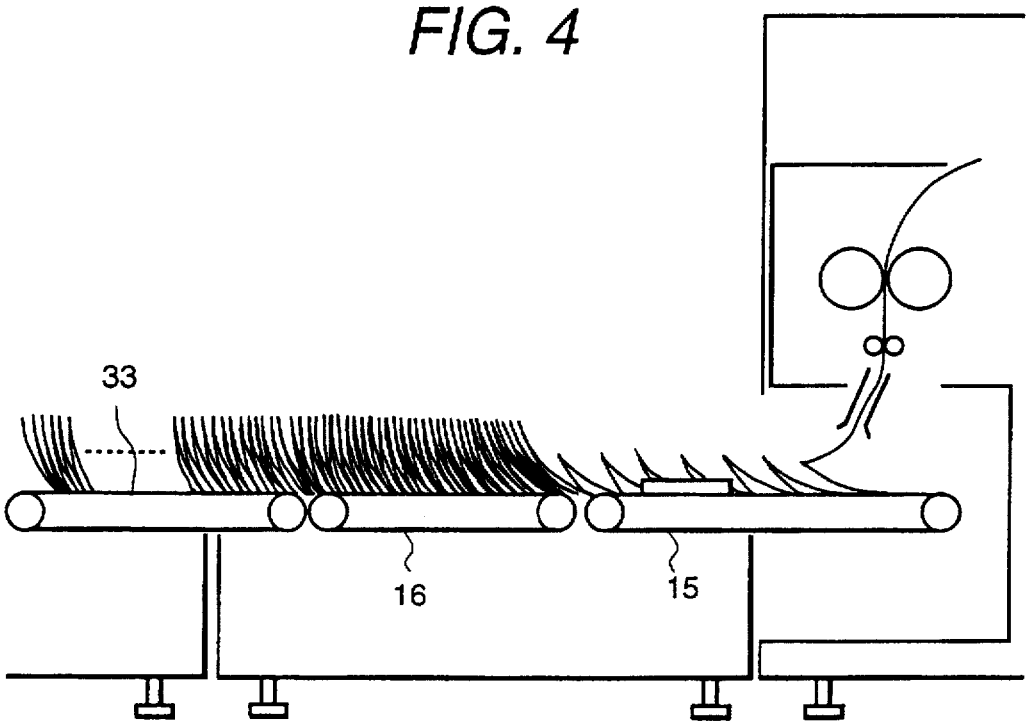
FIG. 4 is a diagram showing another embodiment of an electrophotographic apparatus in accordance with the present invention.

It is also possible to increase the stacking capacity, if necessary, by extending the length of the conveyer 16 in the paper transferring direction or by adding another belt conveyer 33, as shown in FIG. 4.

Figure 5:
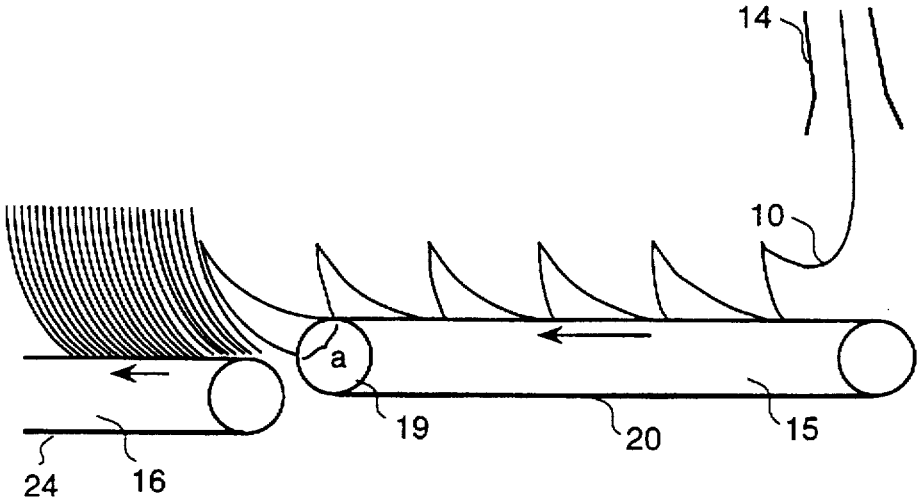
FIG. 5 is a diagram showing the state of a paper sheet passing in an embodiment of a paper transferring conveyer unit in accordance with the present invention.
Figure 6:
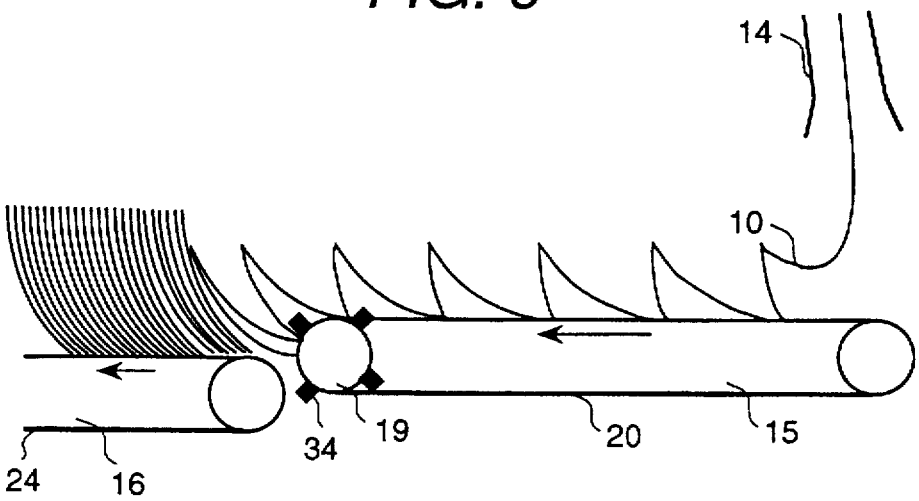
FIG. 6 is a diagram showing the state of a paper sheet passing in another embodiment of a paper transferring conveyer unit in accordance with the present invention.

Further, by arranging the transferring surface of the second conveyer 16 so that it is at a level lower than the transferring surface of the first conveyer 15, when the paper sheets 10 transferred at a high speed from the first conveyer 15 are passed to the second conveyer 16, the contact surface between the paper sheet 10 and the belt 20 is increased by a length corresponding to the outer peripheral region of the driving roller 19, as shown in FIG. 5. Therefore, the paper sheet pushing force produced by the belt 20 is increased. In this case, projecting portions 34 may be provided on the driving roller 19 of the first conveyer 15, as shown in FIG. 6. By doing so, even in a case of transferring special paper sheets, such as glue coated paper sheets, which are apt to slip on the first conveyer 15, it is possible to transfer the special paper sheets by engaging the folded edge of the paper sheet with the projecting portions 34 to drive the folded strip, as seen in FIG. 6.

Figure 7:
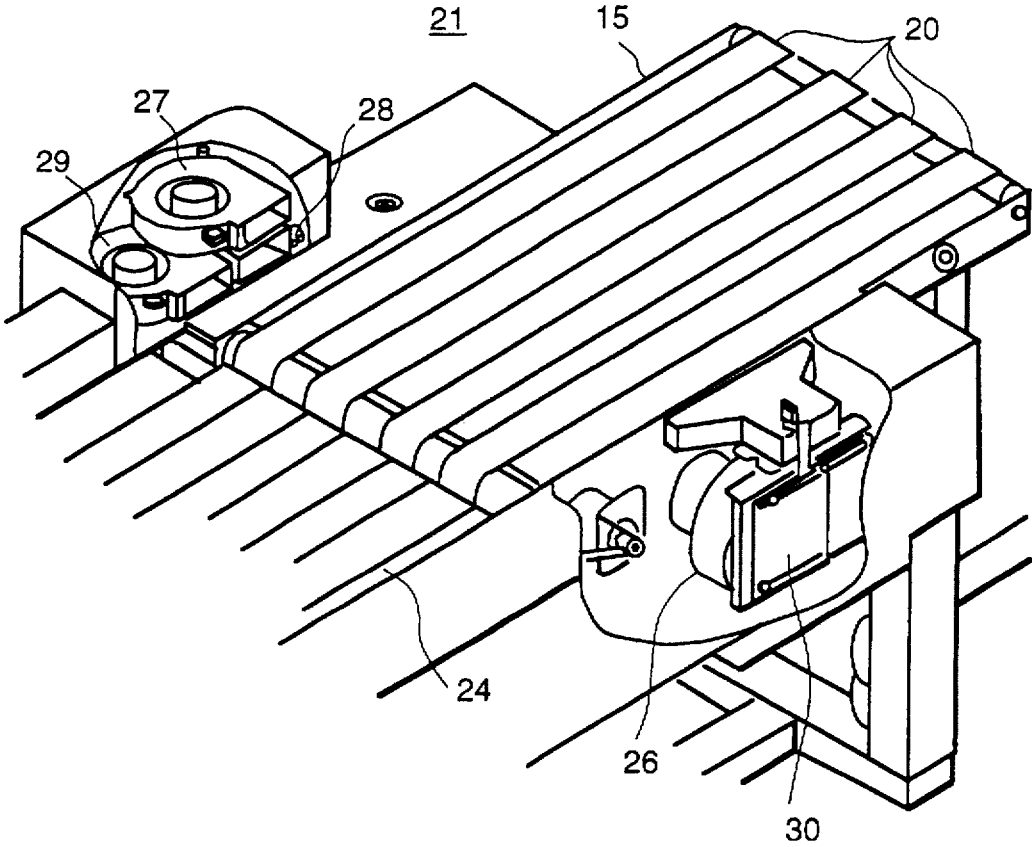
FIG. 7 is a perspective view showing a conveyer unit used in an electrophotographic apparatus in accordance with the present invention.

The paper cooling unit 21 shown in FIG. 1 will be described in detail below, with reference to FIG. 7 and FIG. 8. A large cooling blower 26 is arranged on one side of the first conveyer 15, and small cooling blowers 27, 28, 29 are arranged on the side opposite to the cooling blower 26. An air flow rate control mechanism 30 capable of manually adjusting the air flow rate is provided in the cooling blower 26. The small cooling blowers 27, 28, 29 are divided into three units. Thereby, the number of operated cooling blowers can be automatically varied depending on the length of the paper sheets, the width of the paper sheets forming the continuous strip of paper sheets or the ream weight of the continuous strip of paper sheets to be used. Further, the air flow rate of the cooling blower 26 may be manually controlled by an operator depending on the behavior of the paper sheets at that time.

Figure 8:
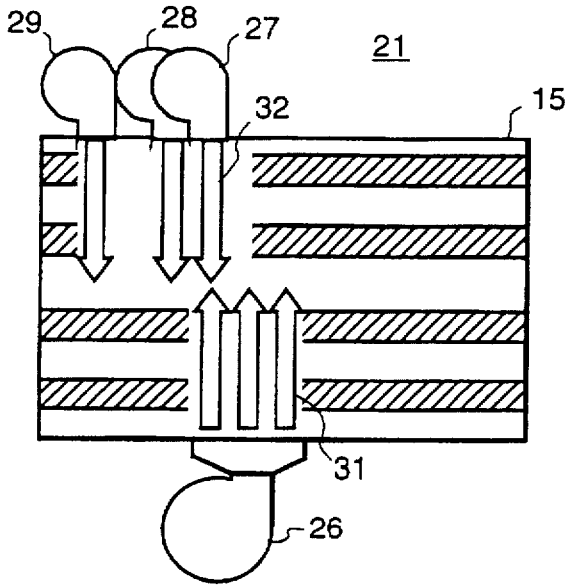
FIG. 8 is a plan view showing a conveyer unit used in an electrophotographic apparatus in accordance with the present invention.

The blowers each are installed in such positions that the cooling blower 26 and the cooling blower 27 are nearly opposite to each other, and part of the cooling air flow 31 of the cooling blower 26 and the cooling air flow 32 of the cooling blower 27 are directed to hit each other, as shown in FIG. 8.

Figure 9:
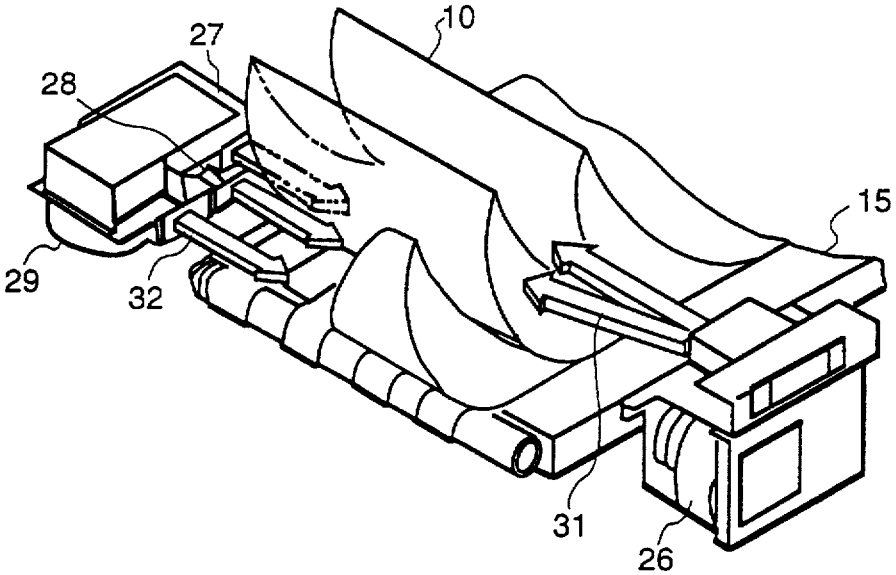
FIG. 9 is a perspective view showing the vicinity of a paper cooling means of a conveyer unit.

The behavior of the cooled paper sheets 10, when the cooling blowers are installed as shown in FIG. 8, will be described below, with reference to FIG. 9 and FIG. 10. The strip of printed paper sheets 10 is loaded on a first conveyer 15 of the paper transferring conveyer unit 1 while the strip of paper sheets are being folded by a swinging action of a swing fin 14 of a folding unit along perforations provided in the strip of paper sheets 10 in advance. The paper sheets are shifted so as to create a space between the paper sheets adjacent to each other by the high speed transferring movement of the first conveyer 15. However, there is a limitation in the rotating speed of the first conveyer 15 in order to maintain alignment of the paper sheets 10. As a result, the area of the paper sheet capable of forming a gap is nearly one-half of the area of one page, and the other one-half area of the one page is overlapped with the preceding paper sheet or the following paper sheet so that cooling air cannot flow into the other one-half area of one page. The gap portion between the paper sheets 10 transferred in such a state is cooled by the cooling air flow 31 produced by the cooling blower 26 in addition to natural convection cooling, as seen in FIG. 9.

Figure 10:
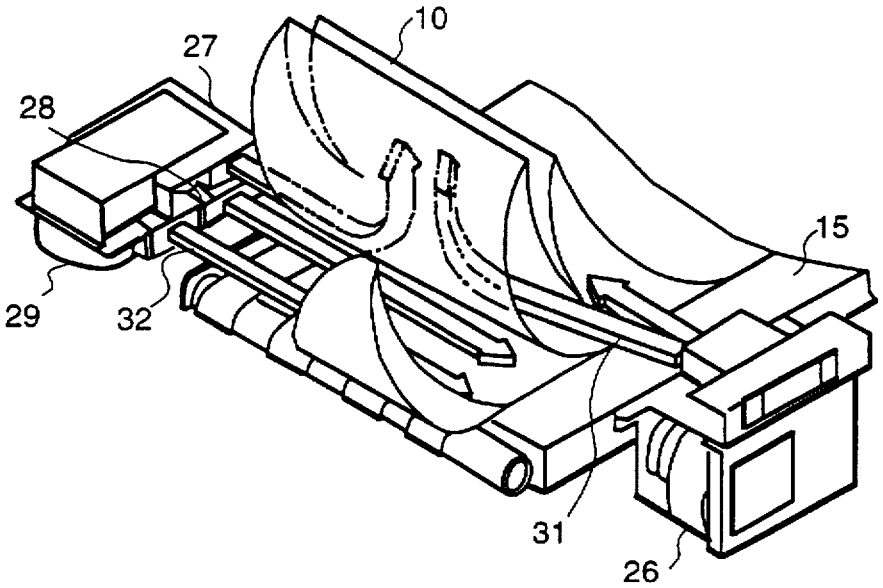
FIG. 10 is a perspective view showing the vicinity of a paper cooling unit of a conveyer unit.

Further, when the paper sheets 10 are transferred up to the position where the cooling blower 26 and the cooling blower 27 are opposite to each other, part of the cooling air flow 31 of the cooling blower 26 and the cooling air flow 32 of the cooling blower 27 enter into the same gap between the paper sheets 10 and lift up the paper sheets 10 by flowing against each other and rising inside the gap so as to open the overlapping portion of the paper sheets wider, as seen in FIG. 10. The cooling air flows of the cooling blower 28 and the cooling blower 29 pass through the widely opened gap to cool the whole area of the paper sheets 10.

A description will be presented below with respect to cases where the number of cooling blowers in operation and the cooling air flow rates are varied depending on the length of the paper sheets, the width of the paper sheets or the ream weight of the paper sheets, referring to FIG. 11, FIG. 12 and FIG. 13.

Figure 11:
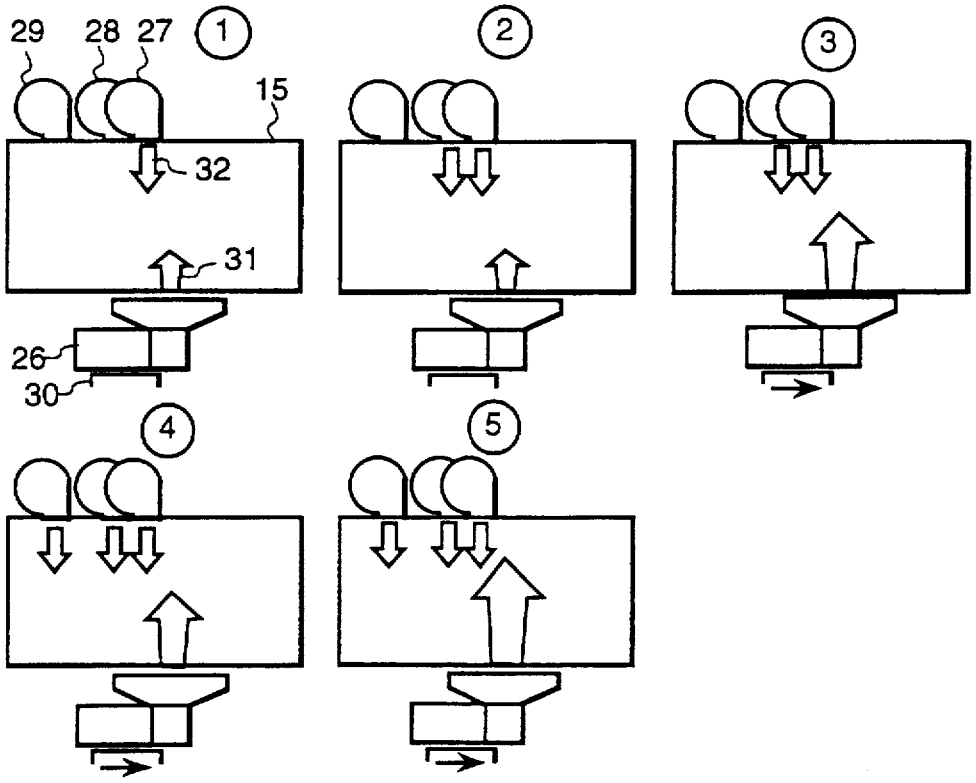
FIG. 11 is an explanatory diagram showing examples of a combination of a number of paper cooling units in operation and the air flow rates.

Five combinations of the number of cooling blowers in operation and the cooling air flow rates are shown at (1) to (5) in FIG. 11. As the paper size (length×width) and/or the ream weight of the paper sheets increases, the number of cooling blowers in operation and the cooling air flow rates should increase, as shown in FIG. 12 and FIG. 13. Therein, the numbers (1) to (5) in FIG. 12 and FIG. 13 correspond to the combinations (1) to (5) shown in FIG. 11. The unit for the length of the paper sheets and the width of the paper sheets is inches.

Figure 14:
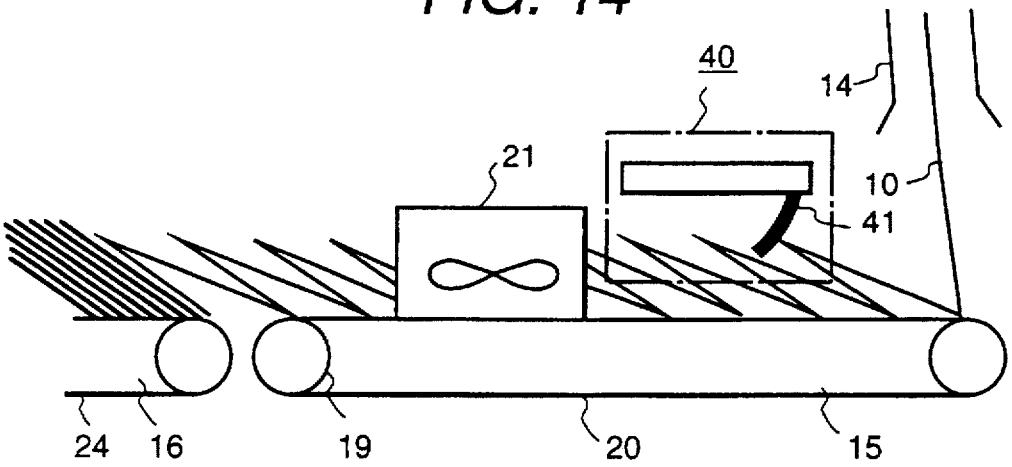
FIG. 14 is a diagram showing the construction of the main portion of an embodiment of a paper sheet guide member in accordance with the present invention.

Details of the paper guide member 40 shown in FIG. 1 will be described below, with reference to FIG. 14.

The strip of paper sheets 10 ejected while being swung by the swing fin 14 is certainly folded by striking the perforations which form the folding line of the paper with the string-shaped members 41 provided in the paper guide member 40 as the strips of paper sheets is loaded on the first conveyer 15. The plurality of string-shaped members 41 are arranged along a line in the width direction of the paper sheets.

Figure 15:
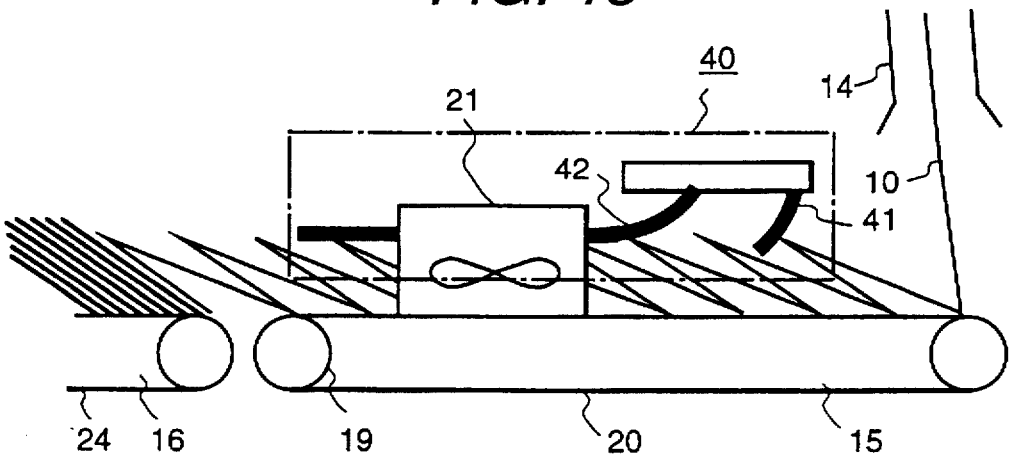
FIG. 15 is a diagram showing the construction of the main portion of another embodiment of a paper sheet guide member in accordance with the present invention.

It is possible to obtain a better alignment of the paper sheets by constructing the paper guide member 40 using string-shaped members 41 and 42, each having a different length, as shown in FIG. 15.

That is, in the first conveyer 15, the driving roller 19 is rotated at a high speed by a driving force transmitted from the motor and, accordingly, the belt 20 is also rotated at a high speed. At that time, the paper sheets are forced to move in the transferring direction of the belt 20 while the top portions of the paper sheets 10 ejected in the form of a zigzag-shape on the first conveyer 15 are raised upright by the string-shaped members 41, 42 to form a uniform horizontally stacked arrangement. As a result, equally spaced gaps are formed between the paper sheets adjacent to one another. Then, cooling air is blown from the aforementioned cooling unit 21 into the equally spaced gaps of the horizontally stacked paper sheets. At that time, the paper sheets 10 are subjected to a load small enough not to interrupt the transferring movement of the belt 20 by the string-shaped members 42 and, accordingly, are pushed against the belt 20. Therefore, the paper sheets 10 cannot be blown off by the cooling air flow and can be efficiently cooled while maintaining a good alignment.

The paper guide member 40 is installed so as to be moved in the transferring direction of the first conveyer 15 or the opposite direction through a driving mechanism, not shown, depending on the length of the paper sheets 10 being used. Thereby, it is possible to push the paper sheets against the belt 20 so as to follow a change in the paper size, and to maintain good alignment of the paper sheets even when the paper size is changed.

Although the string-shaped members 41, 42 are constructed using iron chains, the same effect can be attained when elastic members, such as rubber members, are used.

As described above, according to the present invention, it is possible to provide an electrophotographic apparatus in which toner stick hardly occurs by improving the cooling effect of the continuous strip of paper sheets after they are heat-fixed.

Further, it is possible to provide an electrophotographic apparatus in which the stacking capacity and the handling easiness of paper sheets are improved.

Furthermore, it is possible to provide an electrophotographic apparatus in which the cooling effect on the paper sheets and the alignment of the paper sheets can be stabilized regardless of the length of the continuous strip of paper sheets, the width of the paper sheet and the ream weight of the paper sheets.

What is claimed is:

1. An electrophotographic apparatus comprising:

a fixing unit for heating toner transferred on a continuous strip of paper sheets and for fixing the toner on said strip of continuous paper sheets;

a folding unit for supplying a folding force to said continuous strip of paper sheets transferred from said fixing unit;

stacking means for stacking the folded continuous strip of paper sheets transferred from said folding unit; and gap forming means arranged between said folding unit and said stacking means for contactingly conveying said folded continuous strip of paper sheets to said stacking means, so as to provide predetermined gaps between the folds in said folded continuous strip of paper sheets.

2. An electrophotographic apparatus comprising:

a fixing unit for heating toner transferred on a continuous strip of paper sheets and for fixing the toner on said continuous strip of paper sheets;

a folding unit for supplying a folding force to said continuous strip of paper sheets transferred from said fixing unit;

stacking means for stacking the folded continuous strip of paper sheets transferred from said folding unit; and gap forming means arranged upstream of said stacking means for transferring said folded continuous strip of paper sheets, while forming gaps between the folds in said folded continuous strip of paper sheets, to said stacking means;

wherein said gap forming means includes a first conveyor having a first transferring surface and said stacking means includes a second conveyor having a second transferring surface, said first and second transferring surfaces being arranged in series, the transferring speed of said first transferring surface being set to a speed faster than the transferring speed of said second transferring surface.

3. An electrophotographic apparatus according to claim 2, wherein said second transferring surface is arranged at a level lower than the level of said first transferring surface.

4. An electrophotographic apparatus system according to claim 3, wherein a rotating projecting portion is provided on said first conveyor to engage the folded continuous strip of paper sheets and assist in its transfer to said second transferring surface.

5. An electrophotographic apparatus according to claim 2, wherein paper cooling units are disposed on both sides of said first transferring surface in a substantially orthogonal direction with respect to the transferring direction of said first conveyor.

6. An electrophotographic apparatus according to claim 5, wherein at least one of said paper cooling units is in operation and an air flow rate of said paper cooling units is varied depending on the width of the paper sheets, the length of the paper sheets and the ream weight of the paper sheets of said continuous strip of paper sheets being used.

7. An electrophotographic apparatus according to claim 2, wherein a paper sheet guide member having contact members for applying a load to said strip of continuous paper sheets transferred onto said first conveyor is provided above of said first transferring surface.

8. An electrophotographic apparatus according to claim 7, wherein said contact members are string-shaped members hanging down toward said first transferring surface.

9. An electrophotographic apparatus according to claim 7, wherein said contact members are composed of at least two kinds of string-shaped members having different lengths.

10. An electrophotographic apparatus comprising:

an electrophotographic unit includes a fixing unit and a folding unit, said fixing unit for heating toner transferred on a continuous strip of paper sheets for fixing the toner on said continuous strip of paper sheets, said folding unit for supplying a folding force to said continuous strip of paper sheets transferred from said fixing unit;

a conveyor unit arranged downstream of said electrophotographic unit with respect to a paper sheet transferring direction, said conveyor unit including gap forming means and stacking means, said gap forming means for transferring a folded strip of paper sheets from said folding unit while forming gaps between folds in said folded strip of paper sheets, said stacking means being arranged downstream of said gap forming means with respect to a paper sheet transferring direction for stacking the folded strip of paper sheets transferred from said gap forming means;

wherein said gap forming means includes a first conveyor having a first transferring surface and includes a second conveyor having a second transferring surface, said first and second transferring surfaces being arranged in series, a transferring speed of said first transferring surface being set to a speed which is faster than a transferring speed of said second transferring surface.

11. An electrophotographic apparatus according to claim 10, wherein said second transferring surface is arranged at a level lower than a level of said first transferring surface.

12. An electrophotographic apparatus according to claim 11, wherein a rotating projecting portion is provided on said first conveyor to engage the folded strip of paper sheets so as to assist in its transfer to said second transferring surface.

13. An electrophotographic apparatus according to claim 10, wherein paper cooling units are disposed on both sides of said first transferring surface in a substantially orthogonal direction with respect to a transferring direction of said first conveyor.

14. An electrophotographic apparatus according to claim 13, wherein at least one of said paper cooling units is in operation and an air flow rate of said paper cooling units is varied depending on a width of paper sheets, a length of paper sheets and a ream weight of said continuous strip of paper sheets being used.

15. An electrophotographic apparatus according to claim 10, wherein a paper sheet guide member having contact members for applying a load to said continuous strip of paper sheets transferred onto said first conveyor is provided above said first transferring surface.

16. An electrophotographic apparatus according to claim 15, wherein said contact members are string-shaped members hanging down toward said first transferring surface.

17. An electrophotographic apparatus according to claim 15, wherein said contact members are composed of at least two kinds of string-shaped members having different lengths.

* * * * *